United States Patent [19]

Schantz et al.

[11] 3,958,094

[45] May 18, 1976

[54] KICKOUT SWITCH AND BUZZER

[76] Inventors: Spencer C. Schantz, 16608 W. Rogers Drive, New Berlin; William R. Berry, W186 N6977 Mercy Road, Menomonee Falls, both of Wis.

[22] Filed: Sept. 6, 1974

[21] Appl. No.: 504,006

Related U.S. Application Data

[60] Division of Ser. No. 402,518, Oct. 1, 1973, which is a continuation-in-part of Ser. No. 306,526, Nov. 15, 1972, Pat. No. 3,815,082.

[52] U.S. Cl. ..... 200/283

[51] Int. Cl.[2] ..... H01H 3/48

[58] Field of Search..... 200/283, 159 A, 246, 200/284; 335/151, 154

[56] References Cited

UNITED STATES PATENTS

| | | | |
|---|---|---|---|
| 3,189,719 | 6/1965 | Holzer | 200/283 X |
| 3,683,144 | 8/1972 | Bowen et al. | 200/283 X |
| 3,713,055 | 1/1973 | Halbeck | 200/283 X |

FOREIGN PATENTS OR APPLICATIONS

| | | | |
|---|---|---|---|
| 388,418 | 2/1965 | Switzerland | 200/159 A |

*Primary Examiner*—Herman J. Hohauser
*Attorney, Agent, or Firm*—Arthur L. Morsell, Jr.

[57] ABSTRACT

An electric coil is coupled across a pair of normally closed electric contacts which are attached to two electric terminals. The contacts and terminals are supported by pockets in an insulating base member which also supports a bobbin upon which the electric coil is wound. Each terminal is supported within its pocket by a pair of spaced legs having projecting spurs which bite into the margins of the pockets and prevent the terminals from being withdrawn. An armature is pivotally mounted over one end of the coil, and an actuating arm is attached to the armature for opening the contacts in response to a predetermined amount of movement by an object in contact with the actuating arm. This energizes the coil by removing the short circuit around it and causes the armature to buzz until the coil is de-energized.

2 Claims, 17 Drawing Figures

Fig. 9
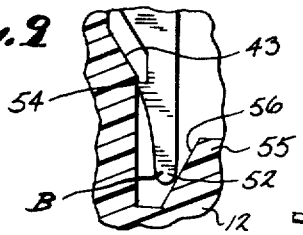
Fig. 1
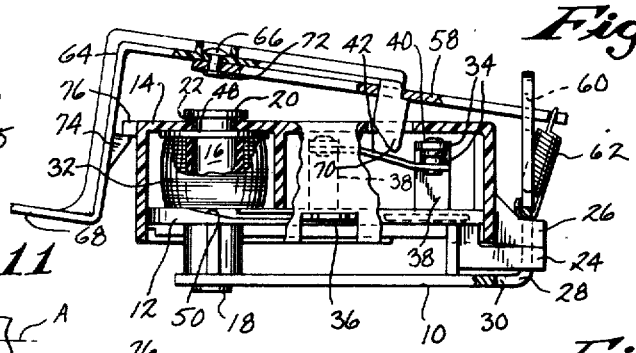
Fig. 10
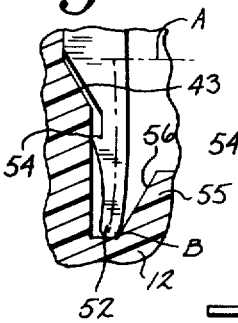
Fig. 11
Fig. 2
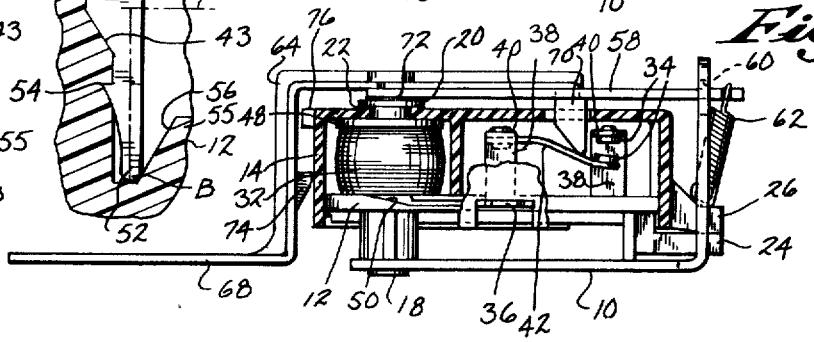
Fig. 3
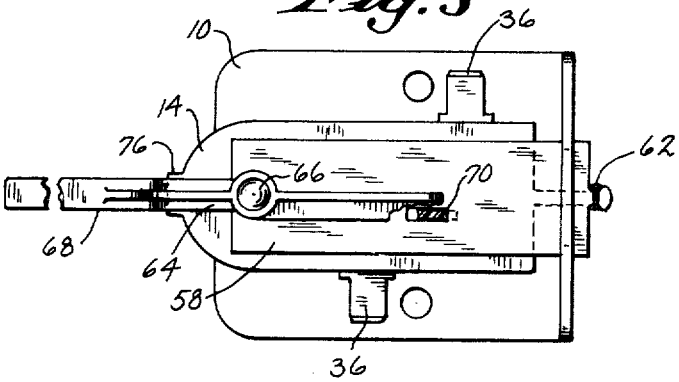
Fig. 4
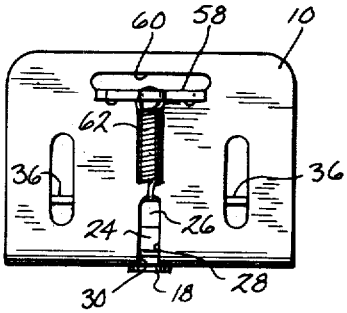
Fig. 5
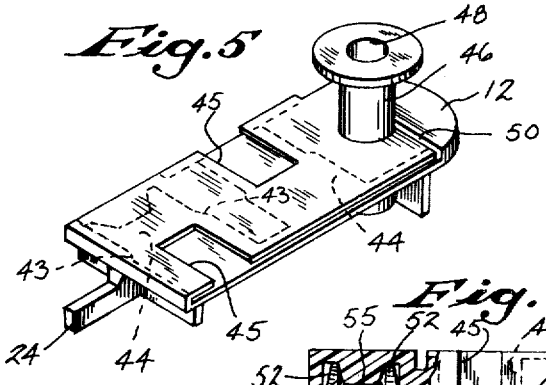
Fig. 6
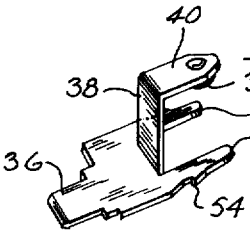
Fig. 7
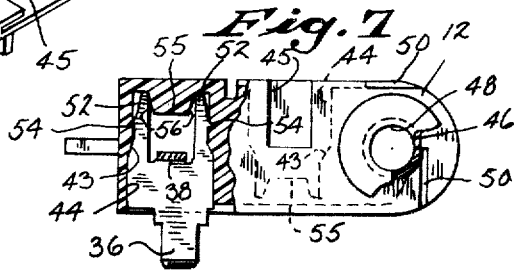
Fig. 8
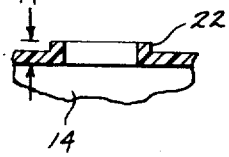

KICKOUT SWITCH AND BUZZER

CROSS REFERENCE TO RELATED APPLICATIONS

This application is a division of co-pending application, Ser. No. 402,518, filed Oct. 1, 1973, which was a continuation-in-part of application Ser. No. 306,526, filed Nov. 15, 1972, now U.S. Pat. No. 3,815,082, dated June 4, 1974.

BACKGROUND OF THE INVENTION

This invention relates to kick-out switches and buzzers such as used in connection with washing machines to provide protection against operation with an unbalanced load in the tub. During the operation of a washing machine, it is possible for the clothes in the tub to become so bunched together as to seriously unbalance the tub and cause it to wobble excessively as it spins during the spin-dry portion of the operating cycle. Under such unbalanced conditions, it is necessary to automatically turn the washing machine motor off and to sound an audible alarm which indicates that the washing machine has been turned off due to an unbalanced condition. In the past, these functions have been performed by kick-out switches and buzzers.

The prior art kick-out switches and buzzers have utilized a buzzer structure including a coil which was connected in parallel with a pair of normally closed contacts. The coil and normally closed contacts were connected in series with the AC power input to the washing machine motor. As long as the contacts remained closed, the motor operated normally and the buzzer was silent due to the short circuit provided by the normally closed contacts across its coil. When the contacts were open, however, this connected the coil in series with the washing machine motor, thereby turning the motor off, and simultaneously energizing the buzzer. A kick- out actuating arm was connected between the washing machine tub and the switch contacts to open the contacts when a predetermined amplitude of wobble was present in the tub. After the kick-out switch and buzzer were actuated, they could be reset to their initial condition by turning the washing machine off and then turning it back on again. This de-energized the coil and allowed the normally closed contacts to close again.

But although the prior art kick-out switches and buzzers performed their intended function, they had several serious drawbacks. In the first place, due to the fact that they had to respond to a predetermined amplitude of movement, these prior art kick-out switches and buzzers involved relatively precise dimensions and tended to be relatively expensive. They also tended to be relatively comples and cumbersome in structure and relatively difficult to assemble.

SUMMARY OF THE INVENTION

In accordance with this invention, the above noted drawbacks are overcome by providing a kick-out switch and buzzer in which the coil, terminals, and contacts are all supported upon a common base member which has a bobbin for supporting the coil and two pockets in which the terminals and contacts are supported. The contacts are preferably joined to the terminals by means of contact-supporting arms which extend transversely from the terminals. Slots are formed in the pockets for receiving the contact-supporting arms. A pair of spaced legs preferably extends from each of the terminals for engaging the pockets in the base member. A barb is preferably formed on the outer edge of each leg, and the pockets in the base member are preferably shaped so that the barbs will bite into the side margins of the pockets when the legs are inserted therein.

A case made of deformable plastic material is preferably fitted over the base member and is held in place at one end by an enlarged head on a pole piece which passes through the center of the bobbin and also through an opening in the top of the case. A ring of deformable plastic material preferably projects upwardly from the top of the case under the head of the pole piece to compensate for normal variations in the length of the pole piece and the height of the case and base member. This ring of deformable plastic material insures that the pole piece and case will fit snugly together with the base member in spite of variations in dimensions.

The deformable plastic case and base member are preferably held together at their other end by means of a pair of projecting tabs which fit one on top of the other in an opening of the frame to which the pole piece is secured. The height of the combined tabs is greater than the height of the opening and the tabs are force-fitted into the opening. This insures a snug fit in spite of variations in the dimensions of the case and base member.

An armature is pivotally mounted on the frame for movement toward and away from the pole piece to produce a buzzing sound when the coil is energized by an AC voltage. A kick-out actuating arm is preferably attached to the armature and has a spur portion that extends through the armature and case and bears against one of the contact-supporting members to open the contacts when the actuating arm is moved a predetermined distance toward the pole piece. The kick-out actuating arm also has an outwardly projecting portion that is shaped and dimensioned to engage a portion of a washing machine tub to be moved thereby. The kick-out actuating arm also preferably has an intergral abutment member thereon for limiting the travel of the armature away from the coil.

One of the contact-supporting arms is spring biased to hold the contacts in the normally closed position. The spring-biased arm is oriented diagonally across the plastic case and has a bend therein for increasing the length of the spring-biased arm and thus reducing the spring rate of the arm.

Accordingly, one object of this invention is to provide an improved kick-out switch and buzzer.

Another object of this invention is to provide a kick-out switch and buzzer having a simplified mechanical structure.

A further object of this invention is to provide a kick-out switch and buzzer which is easier to assemble than those heretofore known in the art.

An additional object of this invention is to provide a kick-out switch and buzzer which is less expensive than those heretofore known in the art.

Another object of this invention is to provide a kick-out switch and buzzer in which the coil, terminals, and contacts are all supported upon a common base member.

A further object of this invention is to provided a kick-out switch and buzzer in which each of the terminals and contacts is supported by a spaced pair of barbed legs which bite into the side margins of a pocket in a base member.

Another object of this invention is to provided a kick-out switch and buzzer in which a ring of deformable plastic material is provided under the head of the pole piece to compensate for normal variations in the length of the pole piece and the height of the parts adjacent to the pole piece.

An additional object of this invention is to provide a kick-out switch and buzzer in which the base member and case member are held at one end to the frame by means of a pair of projecting tabs which are forcefitted into an opening in the frame to compensate for variations in the dimensions of the case and the base member.

A further object of this invention is to provide a kick-out switch and buzzer in which an actuating arm having a projecting spur portion acts to open a pair of contacts when moved by a predetermined amount, the actuating arm having a portion which is adapted to engage a portion of a washing machine tub to be moved thereby.

Another object of this invention is to provide a kick-out switch and buzzer in which one of the contract-supporting arms is spring-biased to hold the contacts normally closed and in which the spring-biased contact arm is oriented diagonally across the case and has a bend therein for increasing the length of the arm and thus reducing the spring rate of the arm.

BRIEF DESCRIPTION OF THE DRAWINGS

FIG. 1 is a side view, partially in section, of one illustrative embodiment of the invention in its normal or unactuated state;

FIG. 2 is a side view, partially in section, of one embodiment shown in FIG. 1 in its actuated state;

FIG. 3 is top view of the embodiment shown in FIGS. 1 and 2;

FIG. 4 is an end view of the embodiment shown in FIGS. 1–3;

FIG. 5 is a perspective view of the base member of the embodiment shown in FIGS. 1–4;

FIG. 6 is a perspective view of one terminal and contact member of the embodiment shown in FIGS. 1–4;

FIG. 7 is a top view of the base member shown in FIG. 5 with the terminal member and contact member shown in FIG. 6 mounted thereon;

FIG. 8 is an enlarged detail view of a ring of deformable plastic material which projects upwardly from the top of the case member shown in FIGS. 1 and 2;

FIGS. 9, 10 and 11 are fragmentary horizontal sectional views with a plan view of one of the legs of a terminal member showing progressive positions in its pocket;

DETAILED DESCRIPTION OF THE INVENTION

Figure 12:
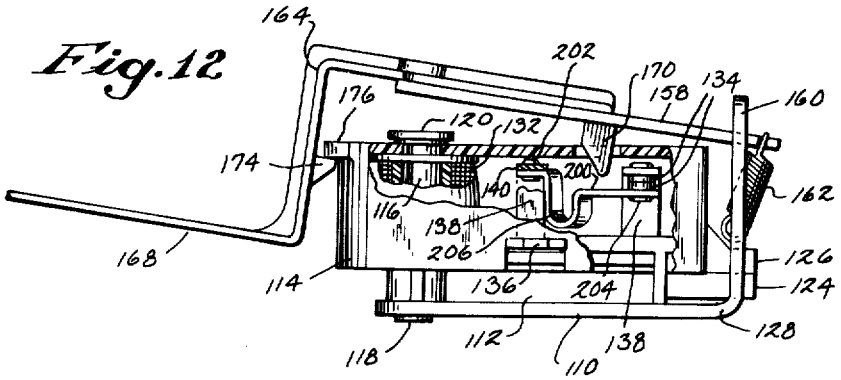
FIG. 12 is a side view of a second embodiment of the invention in its normal or unactuated state, portions of the case being cut away to expose interior details.

Referring to FIG. 1, one illustrative embodiment of the invention includes an L-shaped magnetic frame 10, a base member 12 which is made of an insulating material, and a case member 14 which is made of a yieldable plastic material. The frame 10, base member 12, and a case member 14 are held together at one end by a magnetic pole piece 16 which is staked to the frame 10 at end 18 and has an enlarged head 20 at its other end. The enlarged pole piece head 20 bears against a deformable ring of plastic material 22 which projects from the top of case member 14 under the enlarged pole piece head 20. FIG. 8 shows an enlarged fragmentary detail view of the housing 14 and ring 22 separate from the pole piece head 20.

The plastic ring 22, being of yieldable plastic material which is deformable under pressure, is a particularly important feature of this invention whose function is to compensate for variations in the dimensions of these members due to normal manufacturing tolerances and that this variation in dimensions might possibly result in a loose fit or an excessively tight fit between the members when the pole piece 16 is staked at its end 18 onto the frame 10. In accordance with this invention, however, the height H of the deformable plastic ring 22 is selected to exceed the normal variation of dimensions in the base member 12 and the case member 14 so that the plastic ring 22 will engage the pole piece head 20 when the maximum variation of dimension occurs in the base member 12, case member 14, and pole piece 16. This insures that the pole piece head 20 will make good contact with the ring 22 of the case member 14, to hold the members snugly together for all dimensions of the parts involved. When the variation of dimension is on the long side for the base member 12 and case member 14, or on the short side for the pole piece 16, the deformable plastic ring 22 gets crushed almost down onto the top of case 14 when the pole piece 16 is staked onto the frame 10 at 18. In the other conditions, where the base member 12 and case 14 are on the short side, or the pole piece 16 is on the long side, the ring of deformable plastic material 22 is only slightly deformed but still holds the case 14 snugly against the base member 12 and the base member 12 snugly against the frame 10.

Another deformable fastener is provided at the other end of the base member 12 and case member 14 for holding their other end to the frame 10 in spite of normal variations in dimensions. A tab member 24 projects from the end of base member 12 and a similar tab member 26 projects from the end of case member 14. The tab members 24 and 26 fit one on top of the other and extend through an opening 28 formed in the frame 10. The height of the tab members 24 and 26, taken together, is greater than the height of the opening 28 by an amount which is equal to or greater than the normal variation of height for the tabs 24 and 26. The tab 26 is deformable and the two tab members 24 and 26 are force-fitted into the opening 28 to insure a snug fit in spite of the normal variations of dimensions in the tab members 24 and 26 and in the opening 28.

The opening 28 is extended on its lower portion at 30 so as to expedite the insertion of the tabs 24 and 26 during the assembly process. This is an important feature of the invention because having the tabs 24 and 26 force-fitted into the opening 28 would normally slow down the assembly process and require the application of force in order to assemble the parts. By having the opening 28 extended at the lower end 30, however, the tabs 24 and 26 can be easily inserted into opening 28 at an angle to the frame when the base member 12 and case member 14 are first placed upon the frame 10, and the force-fit between the tabs 24 and 26 and opening 28 is then effected when the pole piece 16 is staked at end 18 onto the frame 10.

Another important feature of the invention is that the base member 12 serves as a common support for a coil 32, a pair of contacts 34, and a pair of terminals 36. One of the contacts 34 is secured to the corresponding terminal 36 by means of a contact-supporting arm 38 which extends transversely from the terminal 36 as shown in FIG. 6, and is bent at right angles to form another contact-supporting arm 40 to which the contact 34 is attached. The other contact 34 is attached to a flexible contact-supporting arm 42 which is attached to the rigid contact-supproting arms 38 and 40 projecting from the side of the other terminal member 36. The two terminal members 36 and their associated contacts 34 are supported in pockets 44 which are formed in the base member 12 and communicate with opposite edges thereof as shown in FIGS. 5 and 7. Slots 45 are formed in the upper surface of pockets 44 to admit the contact-supporting arms 38 which extend transversely from tjhe terminals 36.

A bobbin 46 having an axial bore 48 through the center thereof is provided at one end of the base member 12 for supporting the coil 32 and for allowing the pole piece 16 to pass through the center of the coil 32. Slots 50 are formed in the base member 12 extending between the bobbin 46 and the pockets 44 for carrying wire so that the terminals 36 can be connected to the ends of the coil 32.

As best shown in FIGS. 6 and 7, the terminals 36 have spaced parallel legs 52 projecting therefrom which are adapted to fit within the pockets 44 to support the terminals 36 and their associated contacts 34. A barb 54 is formed on the outer surface of each leg 52 and the margins of the pockets 44 are dimensioned so that the barbs 54 will be able to enter the pockets easily but will bite into the margins of the pockets 44 when the legs 52 are fully inserted therein. As best shown in FIGS. 5 and 7, this is achieved by tapering the margins of the pockets toward their inner ends as at 43 until the distance between the margins of the pockets are less than the distance between the two barbs. To facilitate the interaction between the barbs 54 and the side margins of the pockets 44, outwardle tapered surfaces 56 on an integrally molded wedge 55 are provided within the pockets 44 to engage the inside edges of the legs 52 and cause them to move apart slightly as they approach the bottom of the pockets 44 thereby to elastically deform the legs 52, as shown in FIG. 10, and force the barbs 54 into the side margins of the pockets 44. Referring to FIGS. 9, 10 and 11, first tip B of a leg 52 encounters the taper 56, and then, as insertion continues, the beam portion between A and B of each leg is deformed to a somewhat bowed condition as indicated by the broken line in FIG. 10. When thus bowed as in FIG. 10, energy is stored in the beam portion between A and B so that the center portion of the beam where the barb 54 is located has a tendency to want to straighten out. Thus when the plastic of FIG. 5 is heated during soldering as hereinafter described, it is softened sufficiently that the energy stored in the bowed beam will cause the beam to straighten out as in FIG. 11, pushing the barb 54 into the side margin of the pocket.

The base member 12 is preferably made of a thermoplastic insulating material, and when the ends of the coil 32 are soldered to the terminals 36, the heat from the soldering operation is conducted down the terminals 36 to the barbs 54 and causes them to bite more deeply into the side margins of the pockets 44 aided by the energy stored in the elastically deformed legs as above described, and thus helps to seal the terminals 36 in place within the pockets 44 so that they will resist pull out and not become jarred loose by vibration.

Referring to FIGS. 1–4, a magnetic armature 58 is pivotally attached to the frame 10 within an opening 60 therein and is normally urged upwardly away from the pole piece head 20 by means of an extension spring 62 which is attached between the end of the armature 58 and the top margin of the opening 28 in frame member 10. When an AC voltage is applied across the winding 32, the alternating magnetic field produced thereby in the frame 10 and in the pole piece 16 will cause the armature 58 to alternately be attracted to the pole piece head 20 and moved away from the head 20 by spring 62. This produces a reciprocating action which makes an audible buzz. The buzzing action of the buzzer is, however, normally inhibited by the shorting effect of the normally closed contacts 34.

It is desired to open the contacts 34 to initiate the buzzing action, and also to limit current flow in a washing machine motor connected in series with the contacts 34, when the tub of the washing machine exceeds a predetermined amplitude of wobble. The above-noted function is performed by means of an actuating arm 64 which is attached to the armature 58 by a rivet 66 and which is shaped at one end portion 68 to engage a portion of the washing tub to be moved thereby, and which is shaped at its opposite end 70 to form a spur member which extends through an opening in the armature 58 and through a matching opening in the top of case member 14 and engages the resilient contact-supporting arm 42 which supports one of the two normally closed contacts 34. When the actuating arm 64 is moved toward the coil 32, the spur portion 70 bears against the flexible contact-supporting arm 42 and opens the contact 34 for a predetermined amount of movement at the other end 68 of the actuating arm 64. The contacts 34 are shown in their closed condition in FIG. 1 and in their fully opened condition in FIG. 2 where the actuating arm 64 is moved as far as possible toward the coil 32.

One feature of the actuating arm 64 is that it is shaped to provide the contact-actuating spur 70 and the tub-engaging arm 68 as integral parts of the same unitary member. Another feature is that the rivet 66 is preferably made of a non-magnetic material, and preferably extends at its lower end 72 below the level of the armature 58 so that when the armature 58 moves toward the pole piece head 20, the lower end 72 of the rivet 66 will hold the armature 58 in a slightly spaced condition away from the pole piece head 20 to prevent magnetic sticking of the armature 58 to the pole piece head 20.

Another feature of the actuating arm 64 is that it has an abutment member 74 which interacts with a matching abutment member 76 on case member 14 for limiting the travel of the armature 58 away from the pole piece head 20 under the urging of the extension spring 62. The abutment member 76 is preferably integrally molded with the case member 14, which is made of plastic material. The fact that abutment members 74 and 76 are integrally molded with their respective supporting members 64 and 14 is an important feature of this invention because it allows members 64 and 14 to perform an additional function at no added cost.

OPERATION OF THE INVENTION

In the application of the above-described embodiment of the invention, the frame 10 of the device is mounted by means of any suitable prior art fastening means so as to position the extended portion 68 of the actuating arm 64 in such position that a predetermined amount of wobble of the washing machine tub will cause the spur member 70 of the actuating arm 64 to open the normally closed contacts 34. Ther terminals 36 are then electrically coupled in series with the washing machine motor so that the normal operating current for the washing mchine motor will pass through the contacts 34, which are shorted across the coil 32, whose ends are coupled to the terminals 36. Thus, in the normal operation of the washing machine, the current for the washing machine motor flows through the contacts 34, but the low resistance of the contacts 34 does not appreciably alter or impede the flow of current nor in any way interfere with normal operation of the washing machine as long as the contacts 34 remain closed.

When the washing machine tub begins to wobble beyond its predetermined amount, however, this mechanical movement is coupled through the portion 68 of the actuating arm 64 and presses the spur portion 70 of the actuating arm 64 sufficiently against the contact-supporting spring 42 to cause the contacts 34 to open. When this occurs, the coil 32 becomes coupled in series with the washing machine motor, which limits the current to such a low level that the motor ceases operation. The flow of AC current through the coil 32 sets up an alternating magnetic field through the pole piece 16, which attracts the armature 58 toward the pole piece head 20 and causes the end 72 of the non-magnetic rivet 66 to strike the pole piece head 20. When the alternating magnetic field drops to zero between cycles, it releases the armature 58 to be moved slightly away from the pole piece head 20 before the next cycle of current causes a magnetic field to attract the armature 58 again.

The dimensions of the spur member 70 and the mounting members for the contacts 34 are such that the armature 58 does not move far enough to close the contacts 34 between cycles of the alternating magnetic field. Therefore, once the contacts 34 have been opened by the spur portion 70 of the actuating arm 64, the contacts 34 remain open and the device acts as a buzzer as long as it is energized by AC voltage applied across the coil 32. There are two possible ways of resetting the device to its original condition: (1) the actuating arm 64 may be mechanically forced away from the head 20 of pole piece 16 far enough for the contacts 34 to close again, which de-energizes the coil 32; or (2) the washing machine switch may be turned off, thereby de-energizing the coil 32 and allowing the contacts 34 to close as the armature 58 moves outwardly away from the pole piece head 20 due to the urging of the extension spring 62. Either one of these two reset methods can be used depending upon the particular requirements of the application. Once the device has been returned to its original state by either of the two reset methods, it remains in that state until actuating arm 64 is again moved by wobble of the washing machine tub to the point where the switch contacts 34 again become opened.

Figure 13:
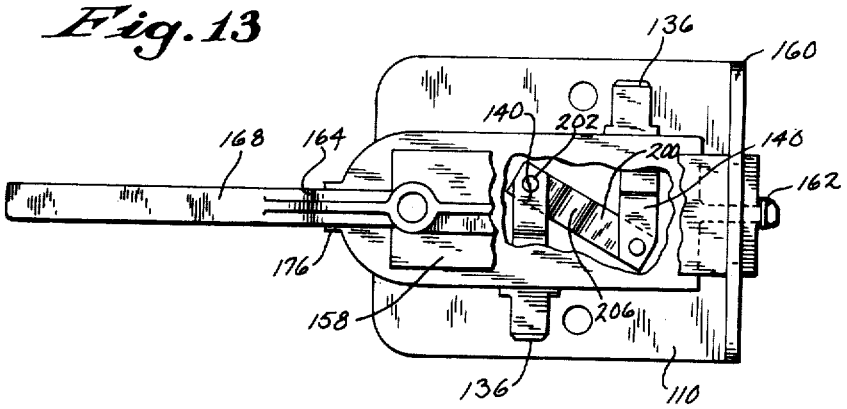
FIG. 13 is a top view of the embodiment shown in FIG. 12, portions of the armature and case being cut away to expose interior details.

FIGS. 12 through 15 show a second embodiment of the invention which differs from the above-described embodiment only by the shape of the flexible contact-supporting arm, all other parts being the same as described above. The same reference numerals plus 100 have been used in FIGS. 12 and 13 to designate parts which are identical with previously described parts, e.g. frame member 110 in FIG. 13 is the same as frame member 10 in FIG. 1, base member 122 in FIG. 13 is the same as base member 12 in FIG. 1, etc.

Referring to FIGS. 12 and 13, the portion of the embodiment which differs from the previously described embodiment is the flexible contact-supporting arm 200 which is attached at one end by a rivet 202 to one of the rigid contact-supporting arms 138 and which is attached at the other end by a rivet 204 to one of the electrical contacts 134. Flexible contact-supporting arm 200 is made out of electrically conductive spring material such as phospor bronze or the like and is so shaped as to provide normally closed pressure on the contacts 134, as will be described hereinafter. A spur 170 projects from actuating arm 164 and bears against arm 200 when actuating arm 164 is moved toward case 114. When the downward pressure of spur 170 exceeds the upwardly spring pressure of arm 200, the contacts 134 wil open. The arm 200 is shaped to provide a relatively high pre-tensioning pressure for holding the contacts 134 in their normally closed position, and this requires a relatively heavy material for the arm 200. Such relatively heavy material has the drawback of having a relatively high spring rate which requires a relatively large force to completely open the contacts 134. The spring rate is defined as the increase of spring force per unit of spring displacement. In accordance with this invention, however, the spring rate of arm 200 is reduced without reducing the pre-tensioned contact pressure by increasing the effective length of arm 200. This is done by orienting arm 200 diagonally within case 114 (see FIG. 13) to allow the length of arm 200 to be increased and by providing a U-shaped bend 206 in arm 200 which further increases its effective length. This increase in length reduces the spring rate. Such a reduction in the spring rate could not be achieved by using a thinner material for arm 200 because the relatively high initial contact pressure required would stress thinner material dangerously near its yield point. Also, arm 200 must have a relatively large cross-sectional area because the contacts 134 carry the motor current for the washing machine or other device with which the kick-out switch and buzzer of this invention is employd.

Figure 14:
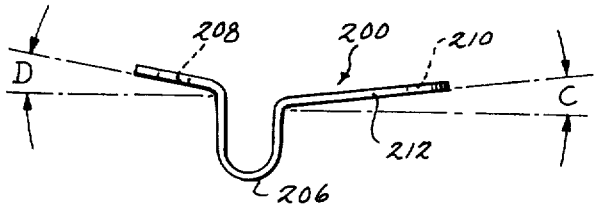
FIG. 14 is an enlarged side view of the contact-supporting spring arm shown in FIGS. 12 and 13.
Figure 15:
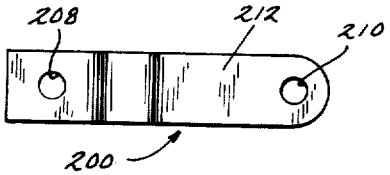
FIG. 15 is a top view of the contact-supporting spring arm shown in FIG. 14.
Figure 16:
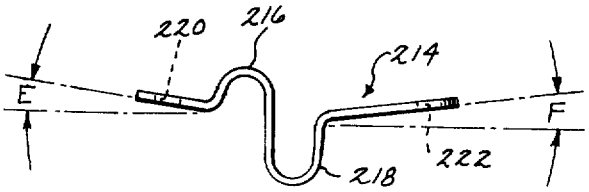
FIG. 16 is an enlarged side view of an alternate contact-supporting spring arm which can be used in place of the arm in FIGS. 12–15.
Figure 17:
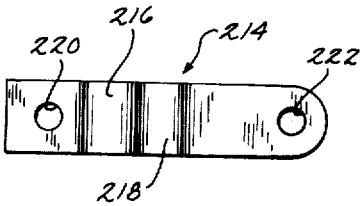
FIG. 17 is a top view of the contact-supporting spring arm shown in FIG. 16.

Referring to FIG. 15, the arm 200 has openings 208 and 210 formed in opposite ends thereof for receiving the rivets 202 and 204, respectively. The U-shaped bend 206 is positioned closer to opening 208 than to opening 210 to provide a flat area 212 against which the spur 170 may bear. As shown in FIG. 14, the portions of arm 200 adjacent to the bend 206 are bent upwardly at angles C and D to lines which are perpendicular to the sides of bend 206. The angles C and D cause the arm 200 to be normally stressed when it is in its rest position (see FIG. 12) to provide the above-noted normally closed contact pressure for contacts 134. The angles C and D are selected in accordance with well-known prior art techniques to provide the required normally closed contact pressure. The depth of bend 206 is selected in accordance with the desired reduction in spring rate within the limitations imposed by the base member 112; the deeper the bend 206, the greater the increase in effective length of arm 200, and the greater the reduction in the spring rate. For even greater reductions in spring rate, a flexible contact-supporting arm 214 (FIGS. 16 and 17) having a serpentine bend with an upper U-shaped bend 216 and a lower U-shaped bend 218 may be employed. The serpentine bend provides a somewhat greater increase in effective length of the contact-supporting arm than a single U-shaped bend of the same depth. Contact-supporting arm 214 has openings 220 and 222 formed at opposite ends thereof for receiving rivets 202 and 204, repsectively. The portions of arm 214 adjacent to the bends 216 and 218 are bent upwardly at angles E and F to lines which are perpendicular to the sides of bends 216 and 218 to achieve the desired amount of normally closed contact pressure.

From the foregoing description it will be clear that this invention provides an improved kick-out switch and buzzer which is simpler in structure and less expensive in cost than those heretofore known in the art. And although this invention has been illustrated with reference to several specific embodiments, it should be understood that the invention is not limited to the disclosed embodiments since many modifications can be made in the disclosed structures without changing their fundamental principles of operation. For example, although only a normally closed pair of electrical contacts has been used in the disclosed embodiment, it is possible that a normally open pair of contacts might also be desired in other embodiments of the invention and these could be added without in any way altering the operation of the normally closed contacts. Also, although the spur portion which engages the contact-supporting arm to open the contacts in the disclosed embodiment is integral with the actuating arm, it might be desirable in other embodiments of the invention to use a separate spur member for opening the contacts. These and other modifications of the disclosed strcuture will be apparent to those skilled in the art, and this invention includes all such modifications as fall within the scope of the following claims.

What we claim is:

1. In an electric switch having a pair of normally closed contacts, one of said contacts being mounted on a flexible contact-supporting arm, having an actuating arm engageable with said flexible contact-supporting arm to apply pressure thereto to open said contacts, and having an elongated case enclosing said contacts and said flexible contact-supporting arm, the improvement wherein said flexible contact-supporting arm is oriented diagonally with respect to the long dimension of said case to permit an increase in length for said flexible contact-supporting arm, thereby reducing its spring rate, there being upstanding terminals, one of which projects upwardly along a first side of the case and has a right-angular extension projecting transversely of the case to a point near a second side thereof, and wherein the other terminal projects upwardly along said second side of the case and has a right-angular extension projecting transversely of the case to a point near the first side of the case, whereby the ends of said right-angular extensions are so positioned that when the flexible contact-supporting arm is connected to one of said ends, it extends in diagonally oriented relationship toward the end of the other right-angular extension for coaction therewith.

2. In a combination electric switch and relay having an elongated frame, a coil mounted near one end of said frame, a fixed contact supported near the opposite end of said frame adjacent one side thereof, a flexible contact-supporting arm oriented diagonally with respect to the long dimension of the frame, means near the opposite side of the frame fixedly supporting one end of said contact-supporting arm, and a contact supported by the other end of said contact-supporting arm in a normally closed position with respect to said fixed contact and being movable out of engagement with said fixed contact in response to pressure on said contact-supporting arm, said contact-supporting arm having a U-bend near its fixedly mounted end and having an abuttable portion between said U-bend and its contact-carrying carrying end, an actuating arm mounted for pivotal movement on siad frame and having means engageable with said abuttable portion of said contact-supporting arm to apply pressure thereto to open the contacts, and said actuating arm including an armature portion positioned to be acted upon by said coil.

* * * * *